US010485273B2

(12) United States Patent
Righetto et al.

(10) Patent No.: US 10,485,273 B2
(45) Date of Patent: Nov. 26, 2019

(54) GARMENT FOR OUTDOOR USE

(71) Applicant: SAPOPA S.R.L., Vicenza (IT)

(72) Inventors: Piero Righetto, Vicenza (IT); Maria Elena Ghisolfi, Milan (IT)

(73) Assignee: SAPOPA S.R.L., Vicenza (IT)

( * ) Notice: Subject to any disclaimer, the term of this patent is extended or adjusted under 35 U.S.C. 154(b) by 108 days.

(21) Appl. No.: 15/526,776

(22) PCT Filed: Jun. 15, 2016

(86) PCT No.: PCT/IB2016/053519
§ 371 (c)(1),
(2) Date: May 15, 2017

(87) PCT Pub. No.: WO2016/203382
PCT Pub. Date: Dec. 22, 2016

(65) Prior Publication Data

US 2018/0132546 A1 May 17, 2018

(30) Foreign Application Priority Data

Jun. 17, 2015 (IT) ..... 2015A001443

(51) Int. Cl.
*A41D 1/00* (2018.01)
*A41D 1/08* (2018.01)
(Continued)

(52) U.S. Cl.
CPC ..... *A41D 1/08* (2013.01); *A41D 1/14* (2013.01); *A41D 13/0537* (2013.01); *A41D 1/22* (2013.01);
(Continued)

(58) Field of Classification Search
CPC ..... A41D 1/14; A41D 1/08; A41D 13/0537; A41D 2600/10; A41D 2400/38; A41D 15/00; A41D 1/22
See application file for complete search history.

(56) References Cited

U.S. PATENT DOCUMENTS 1,104,632 A 7/1914 Cowen
3,708,799 A * 1/1973 Smithdeal ..... A41D 13/0537 2/231
(Continued)

FOREIGN PATENT DOCUMENTS

CN 202211173 U 5/2012
CN 204032412 U 12/2014

OTHER PUBLICATIONS

International Search Report and Written Opinion dated Sep. 29, 2016 for PCT/IB2016/053519 to SAPOPA S.R.L. filed Jun. 15, 2016.
(Continued)

*Primary Examiner* — Khaled Annis
(74) *Attorney, Agent, or Firm* — Vorys, Sater, Seymour and Pease LLP

(57) ABSTRACT

Disclosed herein is an outdoor garment that may include a trousers element having at least one first layer of material and a half-skirt element suitable for forming a rear half-skirt above the trousers element. The trousers element may include a front region, two lateral regions, a rear region, two lower regions, and a crotch region interconnecting the two lower regions. The half-skirt element may be shaped and dimensioned to transversally extend only from one lateral region to another, and to cover central and lower terminal parts of the buttocks, while leaving the front region of the trousers element free and visible for covering the central front part of the pelvis. The half-skirt element may be of a
(Continued)

Figure 1:
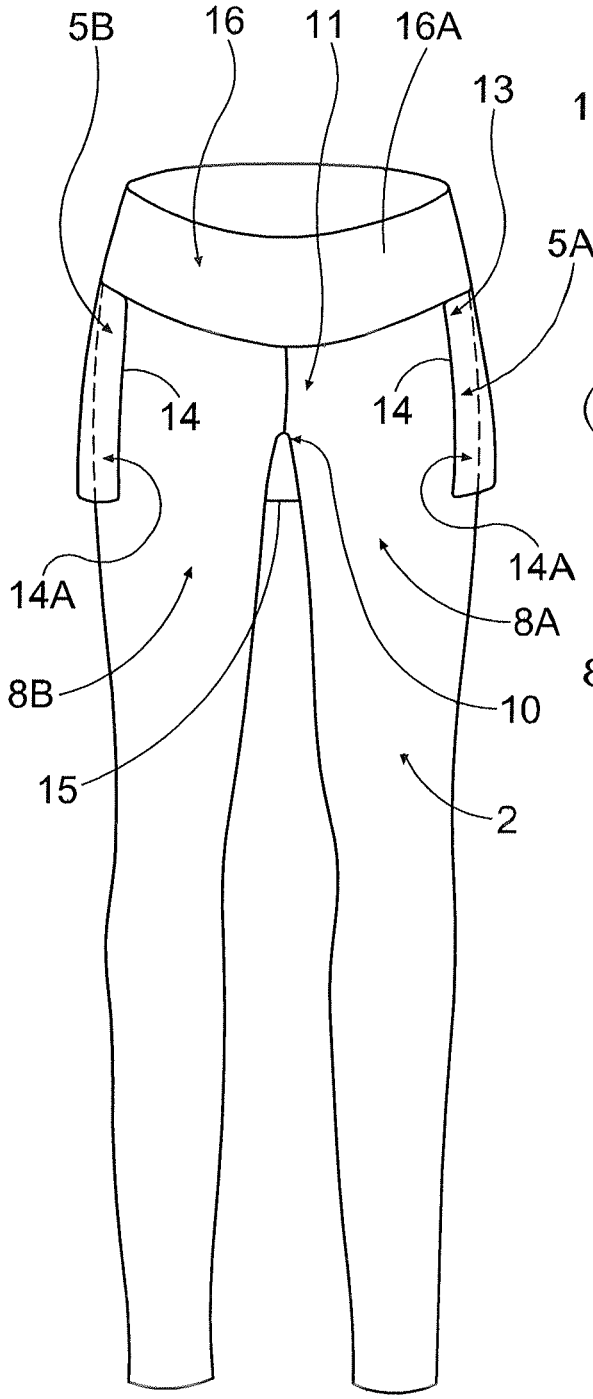

second layer of material separated from the first layer of material of the trousers element.

17 Claims, 13 Drawing Sheets

(51) Int. Cl.
*A41D 1/14* (2006.01)
*A41D 13/05* (2006.01)
*A41D 1/22* (2018.01)
*A41D 15/00* (2006.01)

(52) U.S. Cl.
CPC ..... *A41D 15/00* (2013.01); *A41D 2400/38* (2013.01); *A41D 2600/10* (2013.01)

(56) References Cited

U.S. PATENT DOCUMENTS 4,459,703 A * 7/1984 Kosmas ..... A41D 13/0537 2/338
4,689,829 A * 9/1987 Kaplan ..... A41D 13/0537 2/46
4,894,869 A * 1/1990 Boll ..... A41D 13/1254 2/400
5,068,920 A 12/1991 Bray
6,175,959 B1 * 1/2001 Somers ..... A41D 13/0537 2/455
6,345,391 B1 * 2/2002 Somers ..... A41D 13/0537 2/46
7,735,155 B2 6/2010 Kerkhoff
2007/0101481 A1 5/2007 Stokesbary
2007/0157367 A1 7/2007 Kerkhoff
2011/0145968 A1 6/2011 Tolman

OTHER PUBLICATIONS

European Search Report dated Sep. 22, 2016 for EP Application No. 16174544.
Italian Search Report and Opinion dated Mar. 17, 2016 for IT Application No. UB20151443 to SAPOPA S.R.L. filed Jun. 17, 2015.

* cited by examiner

GARMENT FOR OUTDOOR USE

CROSS-REFERENCE TO RELATED APPLICATIONS

This is a § 371 National Stage Application of International Application No. PCT/IB2016/053519 filed on Jun. 15, 2016, claiming the priority of Italian Patent Application No. UB2015A001443 filed on Jun. 17, 2015.

The scope of the present invention is a garment for outdoor use, according to the pre-characterizing part of the independent claim.

In the present context, by garments for outdoor use we mean garments that, once worn, are visible from the outside (and are called "outwear" garments), therefore this definition does not include the so called "underwear" garments.

Women outwear garments shaped in such a way as to cling to the wearer's body are known for a long time. These garments can include, for instance, leggings or trousers for sports uses (for instance gym, running, or yoga trousers).

The fact that this type of garments clings to the wearer's body is a feature that is particularly appreciated by those who use them, in particular for sports activities, in that they provide an optimum freedom of movement and makes it possible to perform the exercises related to the sports activities without any special constraints.

However, a garment clinging to the body often creates a feeling of discomfort in those wo wear them, because some parts of the body, in particular the buttocks, are very visible and exposed.

On the other hand, those women who use garments, in particular those for sports uses, sometimes have a need for having garments that, whilst perfectly clinging to the body, are also seductive and can help in improving the overall look of those who wear them, in particular if such users have a generous figure.

Document U.S. Pat. No. 5,068,920 describes a suit for water sports wherein the rear part of the trousers includes a patch 32 which is attached to the underneath trousers by way of an adhesive substance which is spread all over the surface of the patch itself and on the underneath surface of the trousers to which the patch is attached, such patch being further attached to the trousers by way of a seam which develops all along the whole perimeter of the patch itself. The complete surface of the patch is thus adhesively attached to the underneath portion of the trousers and forms one indivisible body with the trousers.

Document US 2001/145968 describes a garment for water activities protecting from sun radiations, which includes a pair of shorts and a skirt, wherein the skirt is attached to the shorts by way of lateral seams only and seams provided in correspondence with its upper edge. The skirt described in this document according to the prior art is of a conventional type and is suitable for fully covering the buttocks as well as the sides and the pelvis.

Document CN 202 211 173 describes a non-sewn pant skirt comprising a tubular upper part, a skirt, and a trousers part.

Document US 2007/0157367 describes a pair of trousers comprising a skirt which is attached to the trousers by way of a seam only that develops all along the waistband part of the trousers.

Document U.S. Pat. No. 1,104,632 describes a riding garment with a pant skirt, wherein the skirt is attached on the front to the underneath trousers by way of buttons and respective button holes and is also attached to the waistband part of the trousers.

Document US 2007/0101481 describes a garment comprising a skirt which can be worn above a swimsuit or a pair of shorts, this skirt having wide lateral slits and means for attaching it to the underneath garment.

Document CN 204 032 412 describes a pair of trousers with a skirt wherein the trousers include a number of elastic bands in correspondence with the hips suitable for mating the sides.

An object of the present invention is to realize an outwear garment that, whilst allowing to realize a garment that perfectly clings to the wearer's body and consequently is particularly suitable for performing sports activities, makes it wearability easier also for people that, because, for instance, of their physical constitution, are not fully at their ease with this type of clinging garments.

This object and others that will be apparent to those skilled in this sector are achieved by a garment according to the characterizing part of the attached claims.

Figure 2:
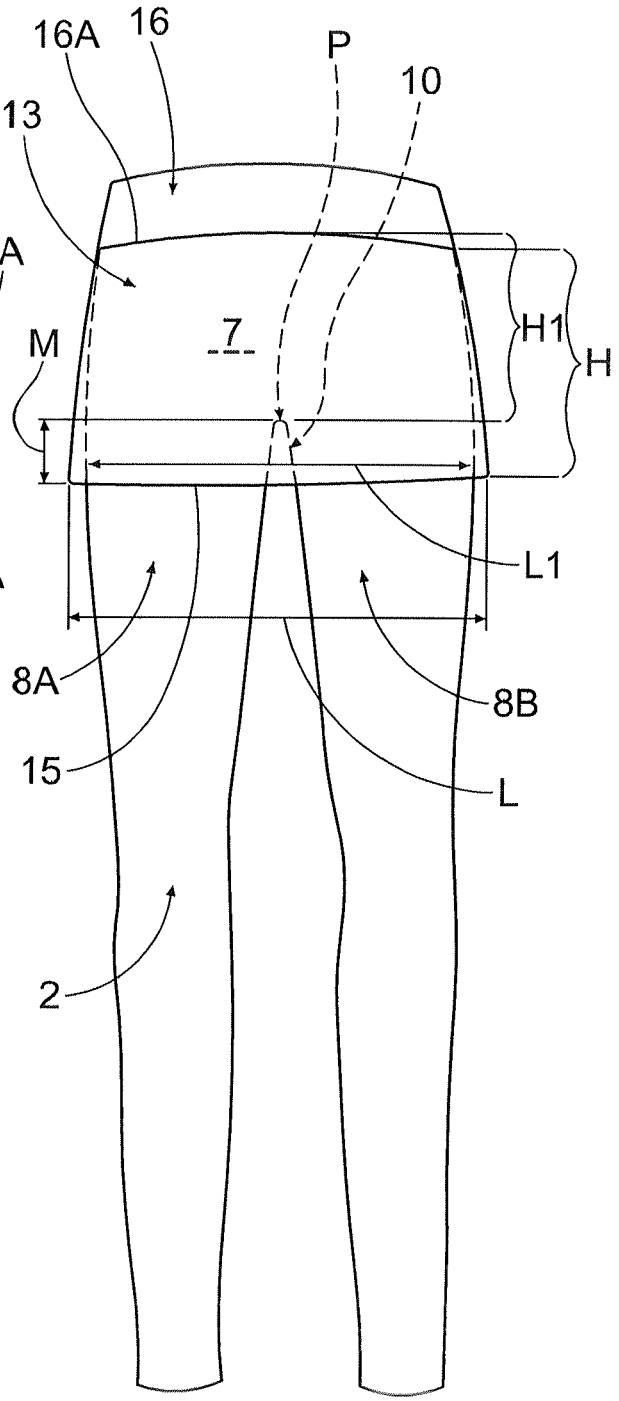
Figure 3A:
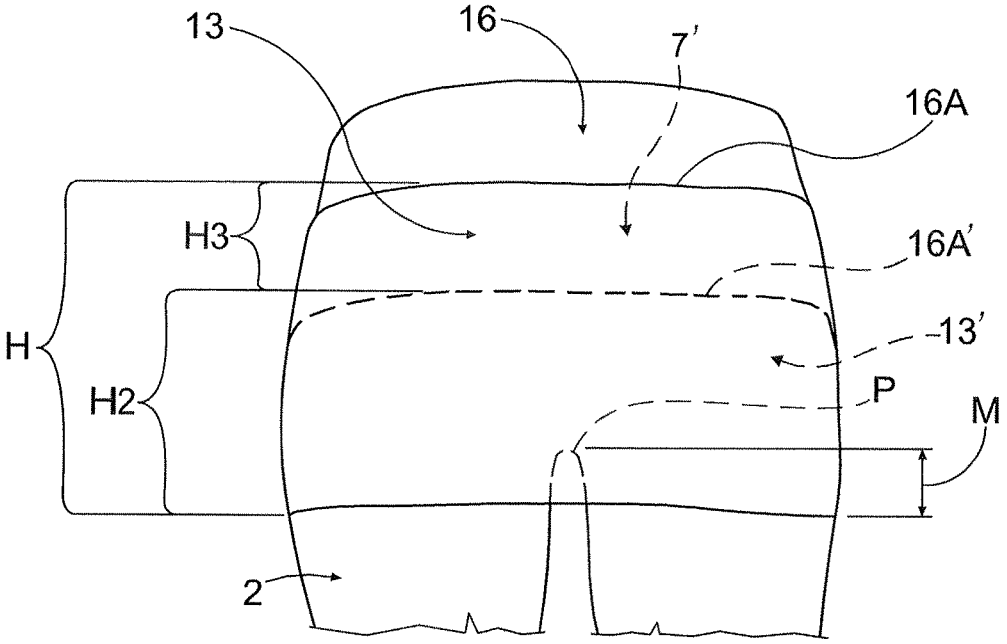
Figure 3B:
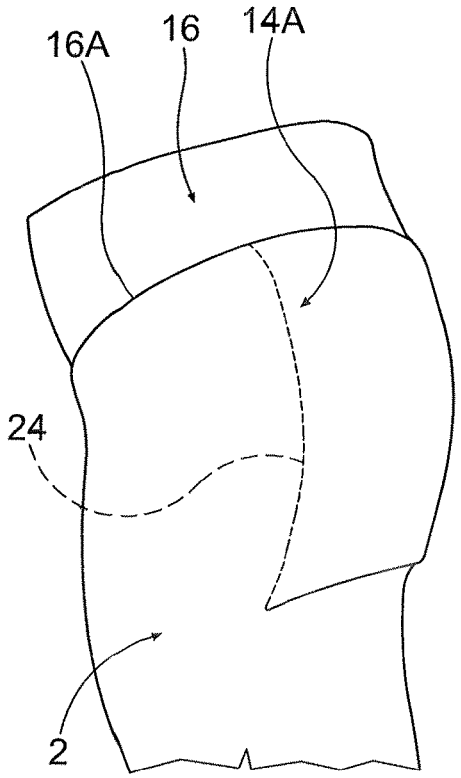
Figure 3C:
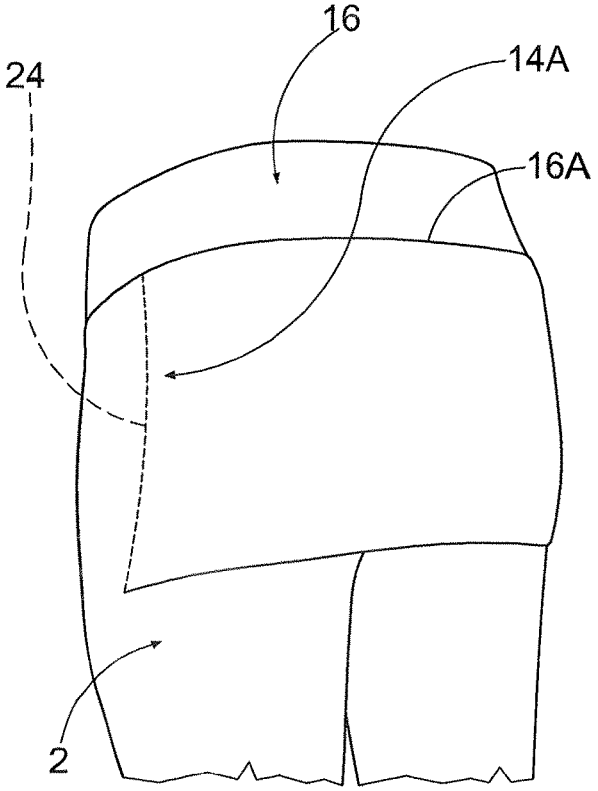
Figure 3D:
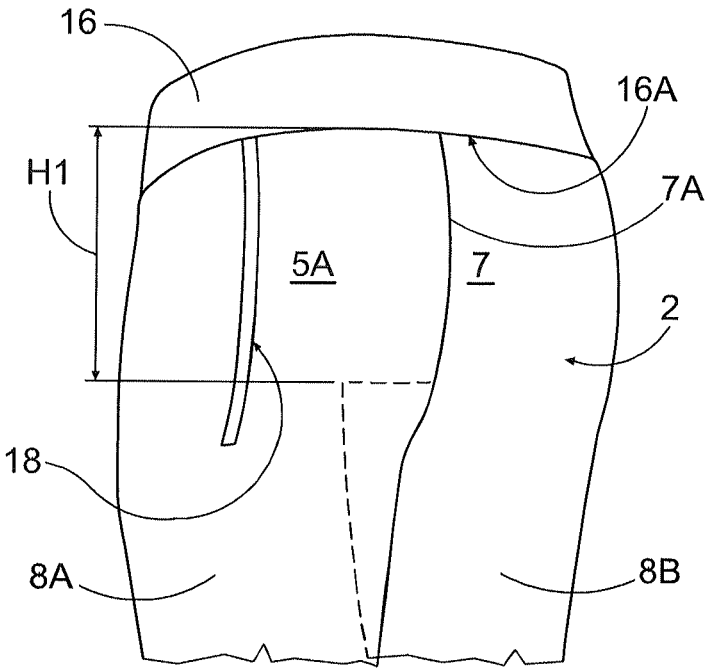
Figure 3E:
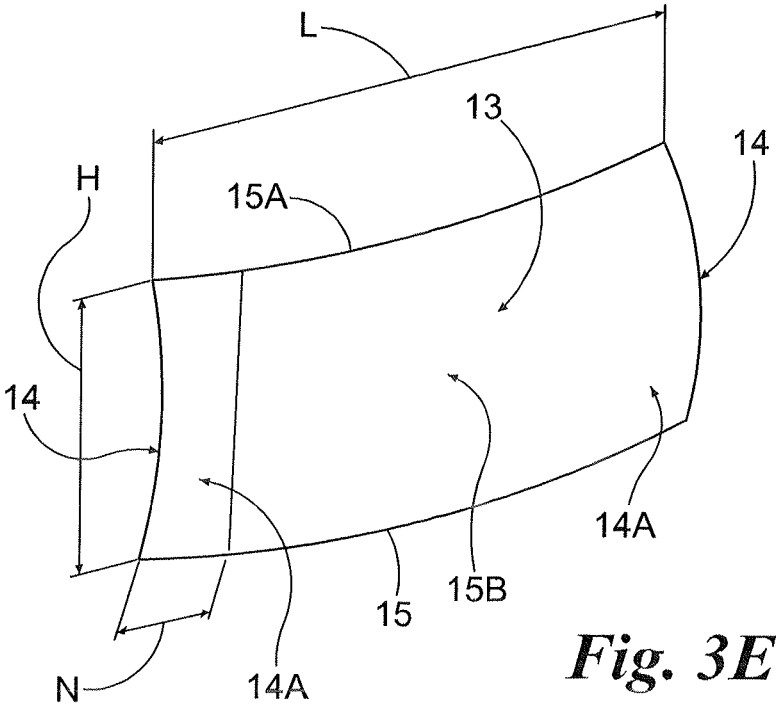
Figure 4:
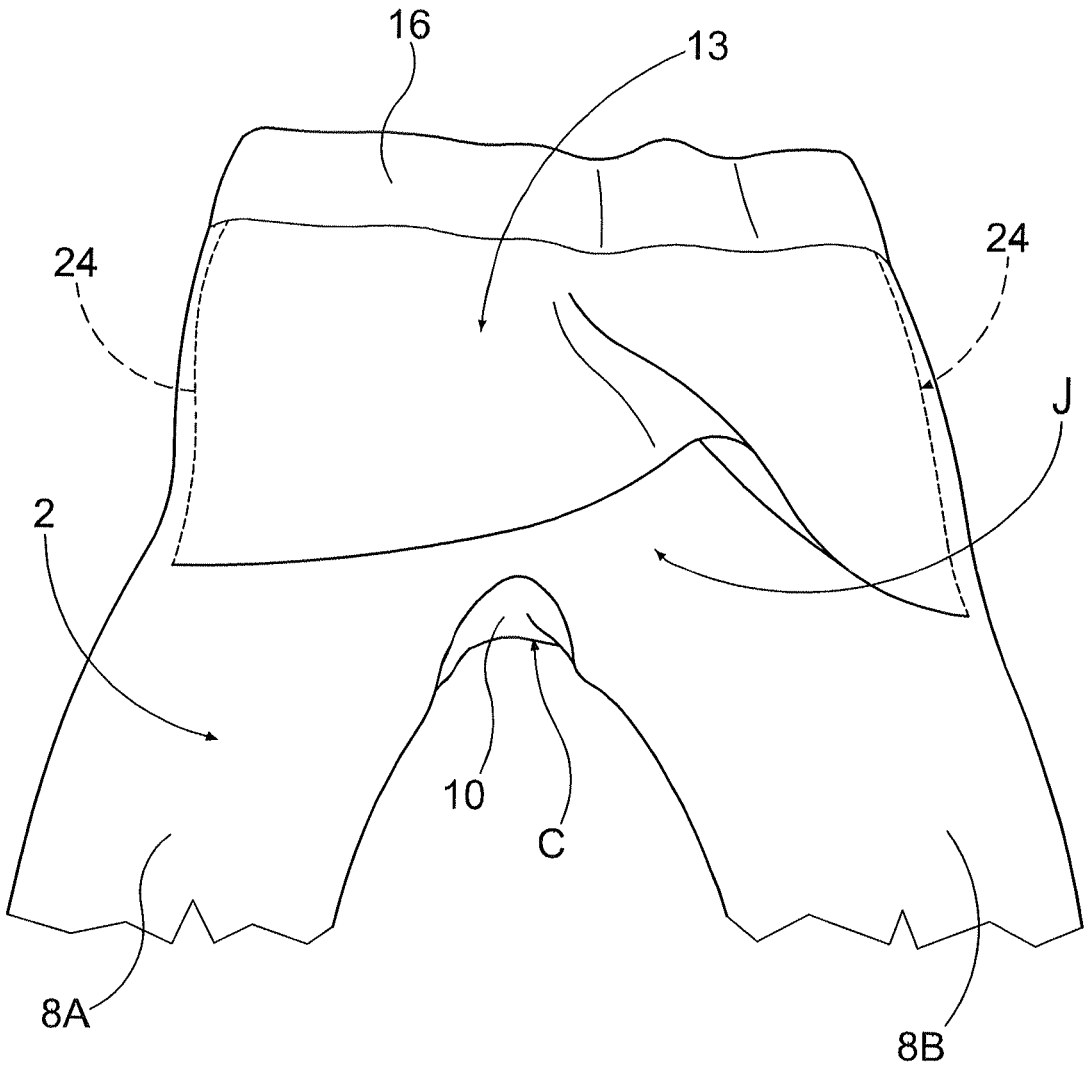
Figure 5A:
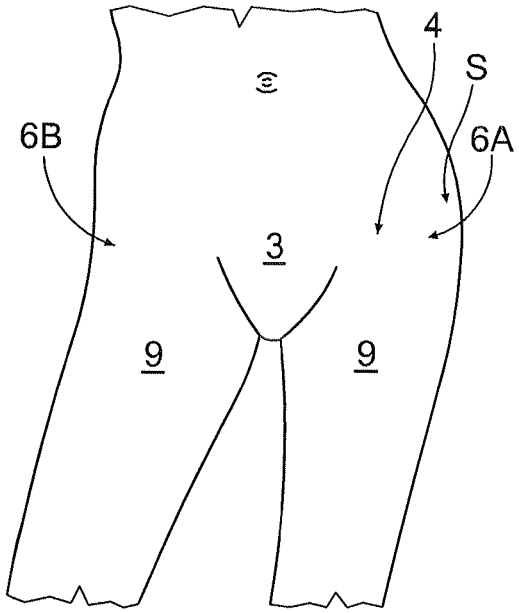
Figure 5B:
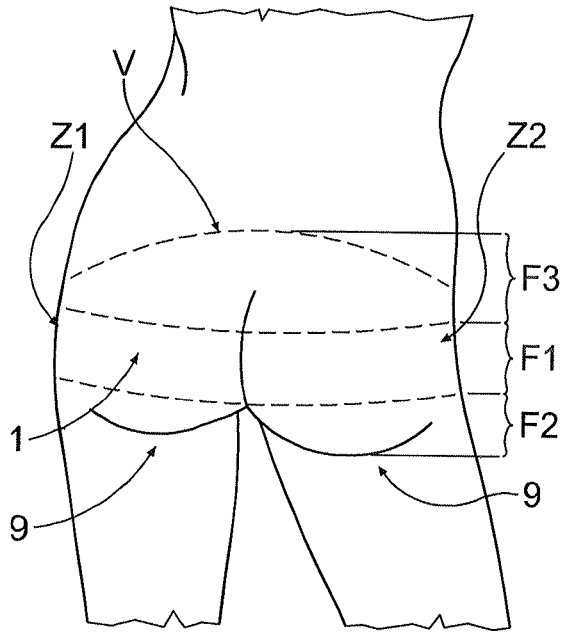
Figure 5C:
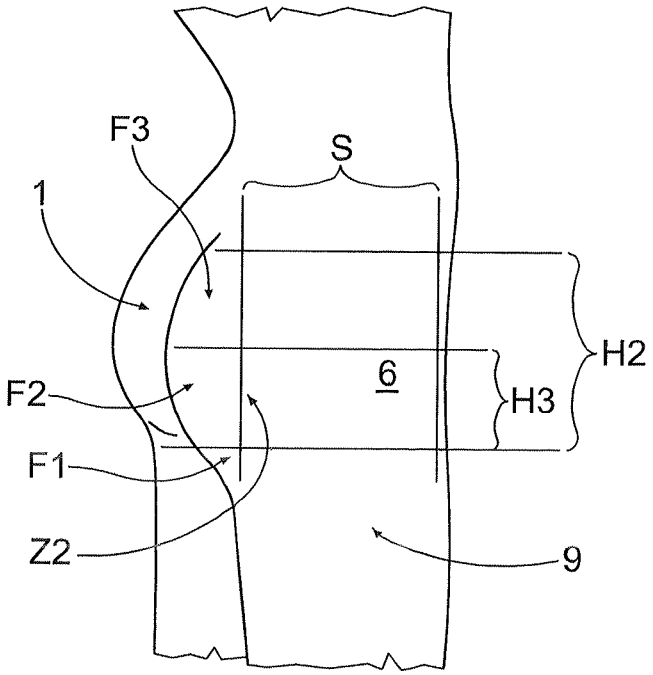
Figure 6A:
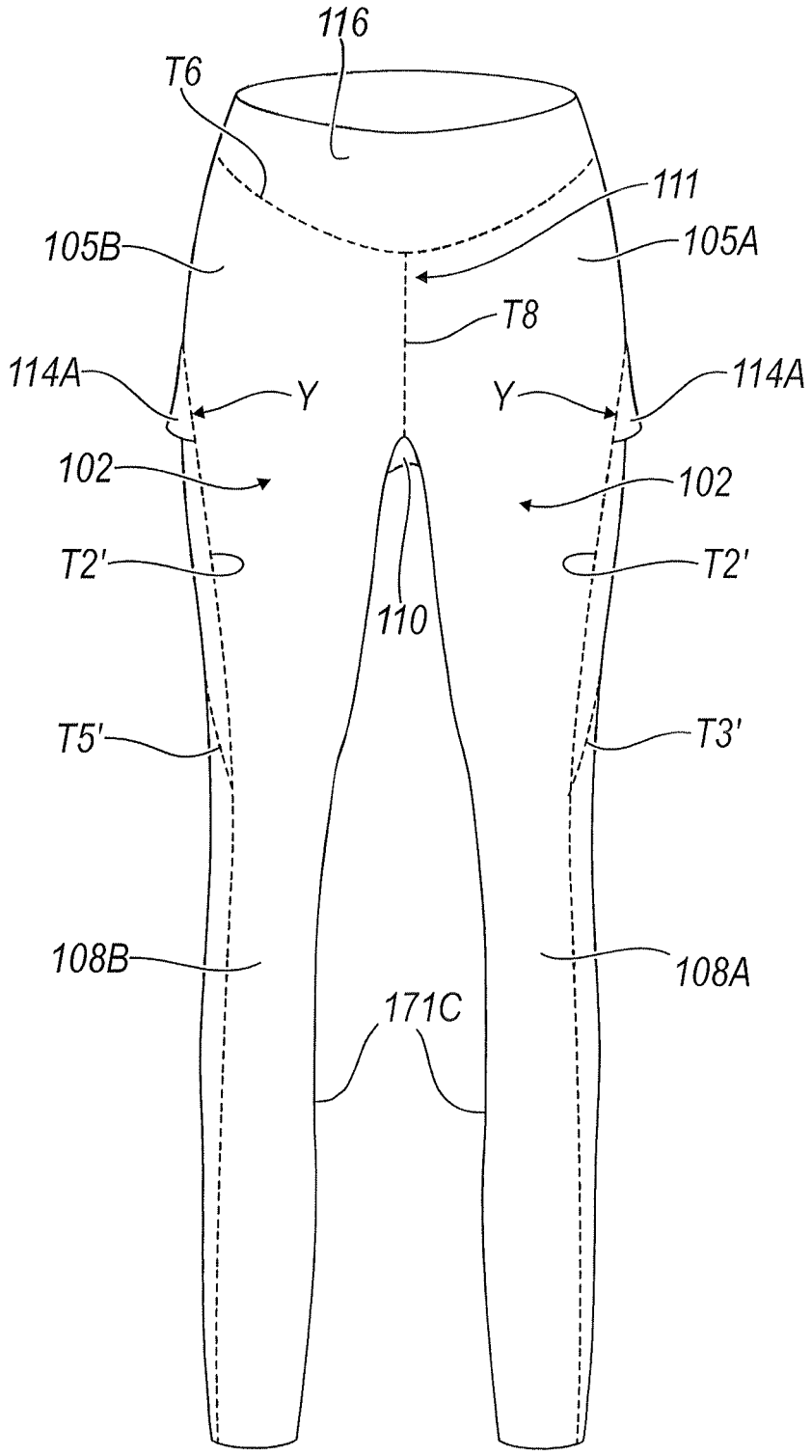
Figure 6B:
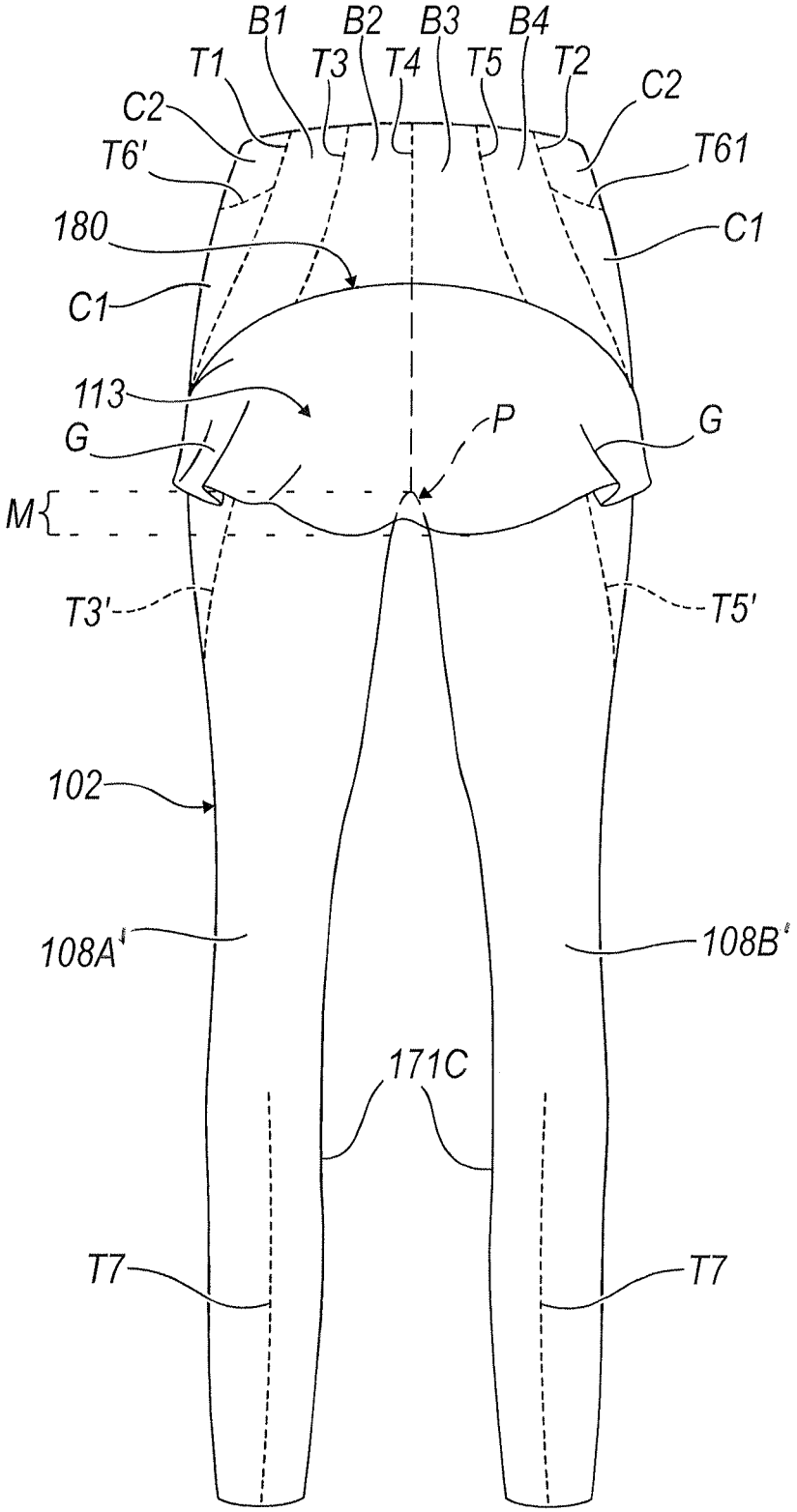
Figure 7:
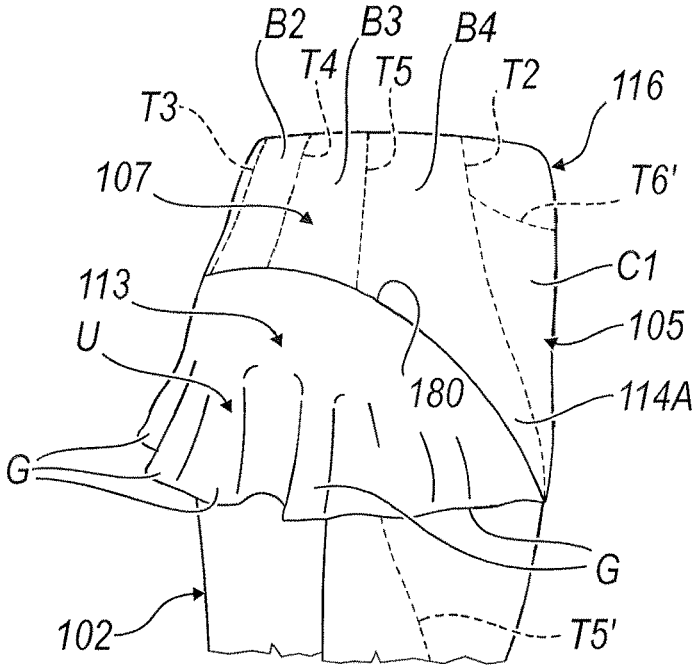
Figure 8A:
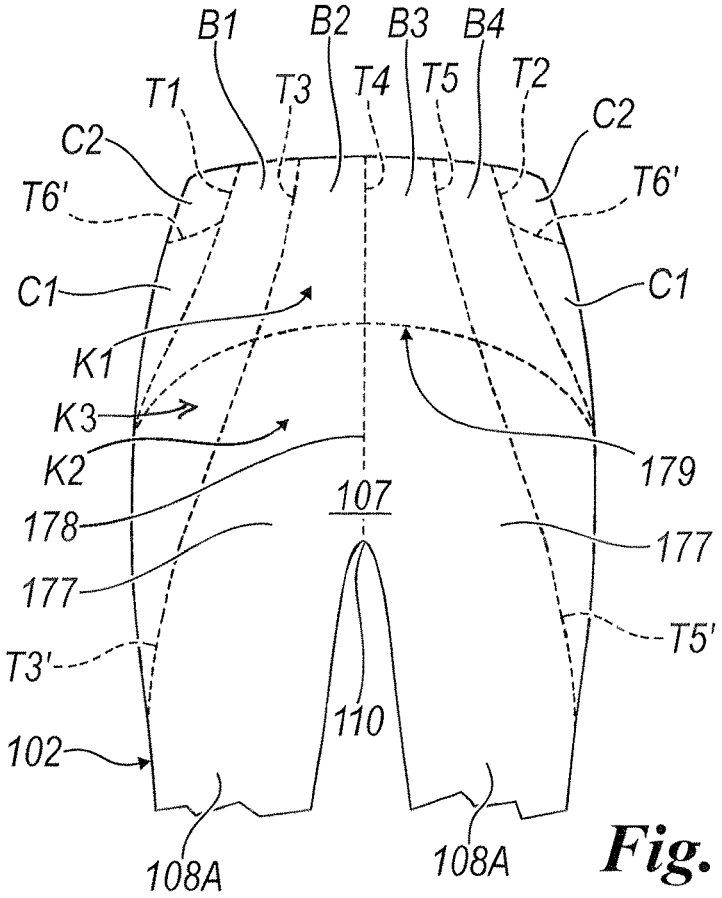
Figure 9A:
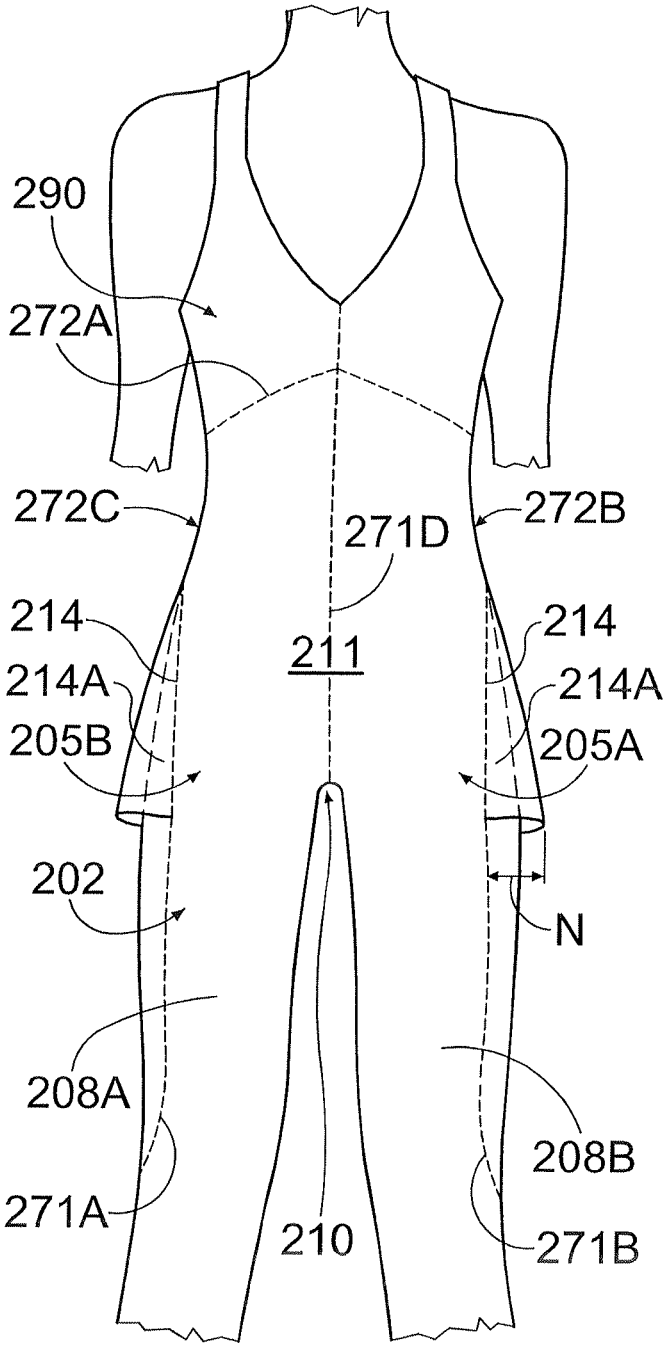
Figure 9B:
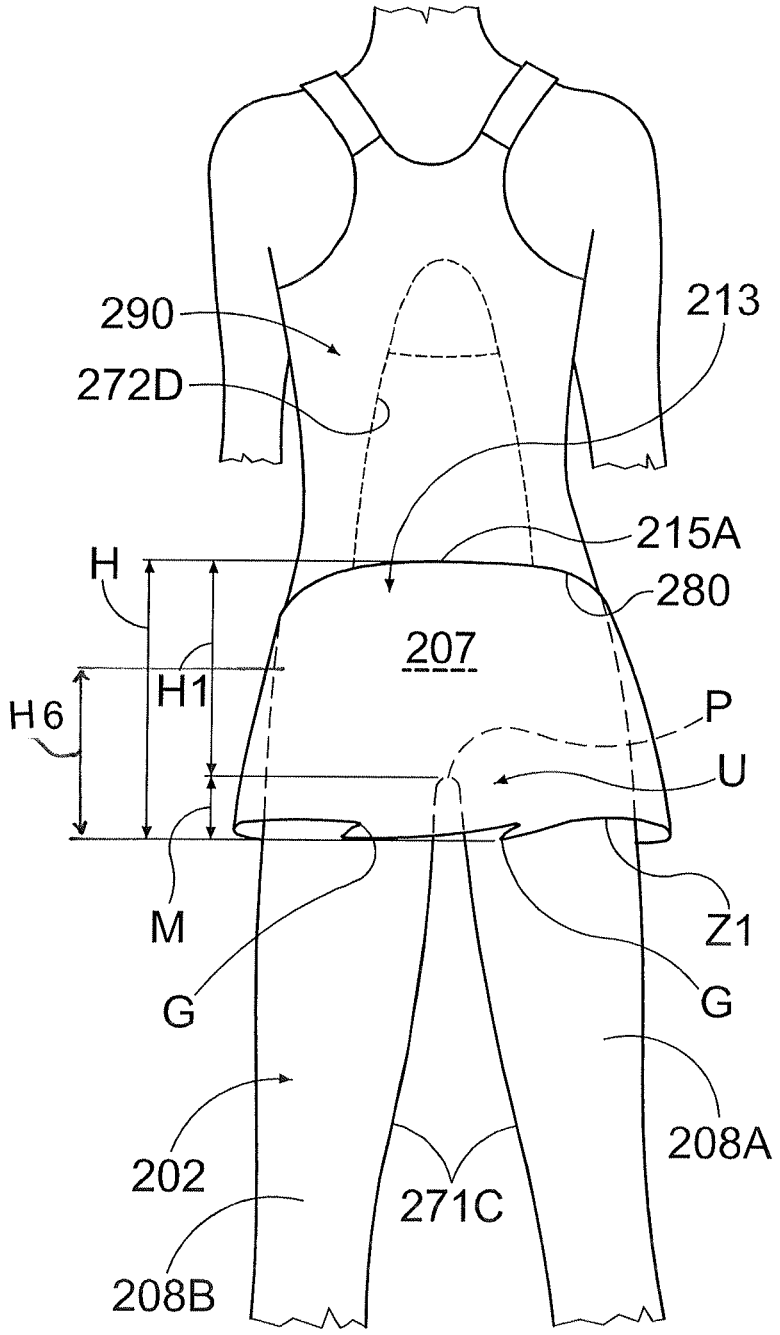
Figure 10A:
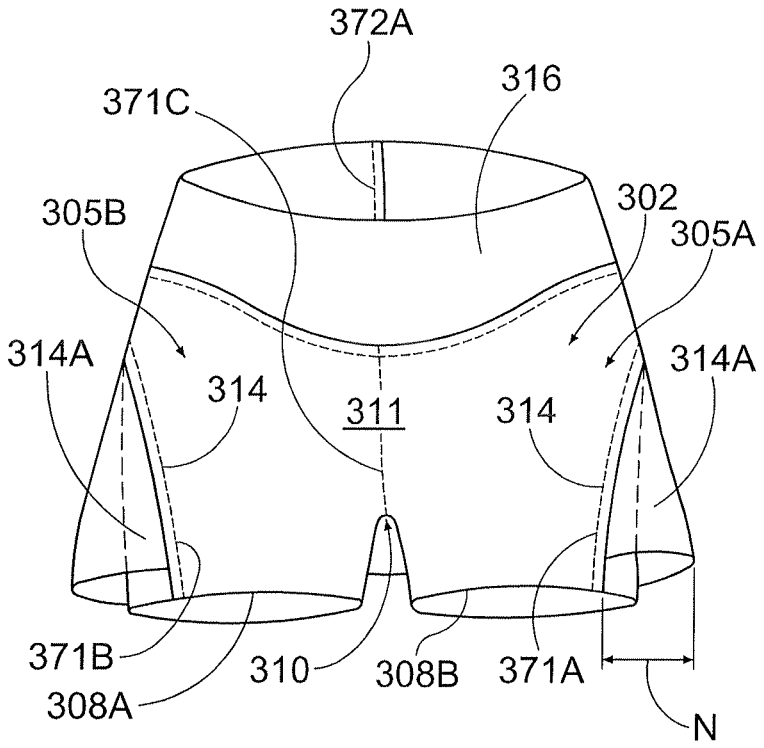
Figure 10B:
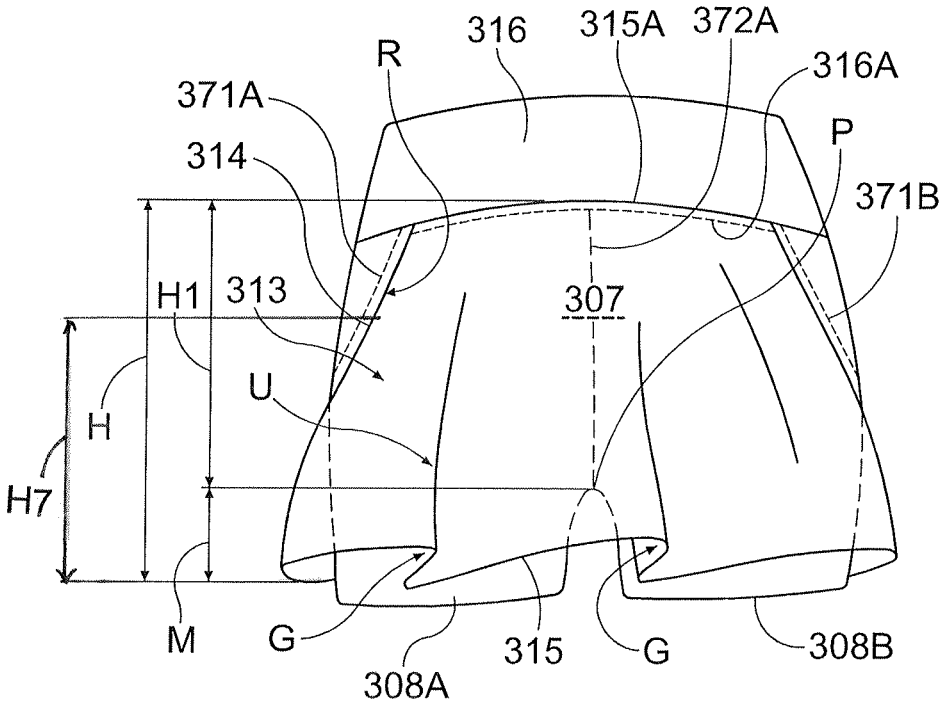

For a better understanding of the present invention, drawings are attached for merely explanatory, but not limitative, purposes, wherein:

FIG. 1 shows a schematic front perspective view of a garment according to the invention, FIG. 2 shows a rear schematic view thereof, FIGS. 3A, 3B, 3C, 3E show schematic perspective views of the rear part only and when the garment is worn respectively, FIG. 3D shows a view thereof like that of FIG. 3C but exploded, i.e. with the two components that make up the garment according to the invention separated from each other, FIG. 4 shows a schematic view of the rear part only thereof, the garment lying in a plane and an external rear part thereof being partially raised from a more internal underneath rear part, FIGS. 5 A-C show a schematic front, rear, and side perspective views of a woman's pelvis, FIGS. 6A and 6B show a schematic front and rear perspective views respectively of a second embodiment of a garment according to the invention, FIG. 7 shows a schematic front perspective view of the garment worn, FIGS. 8A, B show a rear schematic view of the pair of trousers only and of the half-skirt only when said two components that make up the garment according to the invention are separated from each other, FIGS. 9A and 9B show schematic front and rear perspective views respectively of a third embodiment of a garment according to the invention, FIGS. 10A and 10B show schematic front and rear perspective views respectively of a fourth embodiment of the garment according to the invention.

With reference to FIGS. 1-4, they show a first embodiment of a garment according to the invention which, in these drawings, is of a type similar to the trousers of the leggings type, in particular for sports uses. The garment shown in FIGS. 1-4 comprises a first trousers-shaped element 2, which includes:

- a front region 11 suitable for positioning in and covering at least the front zone 3 (FIG. 5A) of a pelvis 4,
- two lateral regions 5A, B (FIG. 1) suitable for positioning in and covering each a zone S (FIG. 5C) of a trousers wearer's body, which substantially extends from a lateral part 6A, B (FIG. 5A) of the pelvis and a lateral terminal zone Z1, Z2 (FIG. 5B) of the buttocks,
- a rear region 7 suitable for positioning in and covering the buttocks 1, two lower regions 8A, B suitable for positioning in and separately covering each at least an upper zone 9 of the legs, and a crotch region 10 interconnecting at least said two lower regions 8A, 8B of the trousers.

This first trousers element consists of at least one first layer of material.

According to the invention, the garment includes a second half-skirt element 13, suitable for forming a rear half-skirt, above the first trousers element 2. This second half-skirt element is shaped and dimensioned:

so as to transversally extend only from one of said two lateral regions 5A (FIG. 1) of the trousers element 2 to the other region 5B, and so as to cover at least a central part F1 of the buttocks, featuring a greater roundness, and a lower terminal part F2 of the buttocks 1, while leaving the front region 11 of the trousers element 2, 102, 202, 302, suitable for covering the front zone 3 of the pelvis, free and visible.

This second half-skirt element 13 is laterally delimited by lateral extremal edges 14 (FIG. 3E), by an upper edge 15A on the top, and by a lower edge 15 on the bottom; these lateral extremal edges 14 are rigidly attached each to part of the underneath lateral regions 5A, B of the trousers element, the lower extremal edge 15 being released from the underneath trousers element. Advantageously is the upper edge 15A also attached to the underneath trousers element, as discussed below in details.

The half-skirt element is thus open, at least on the lower side, and forms an open gap J (FIG. 4) at least on the lower side between the rear region 7 (FIG. 3D) of the trousers element 2 and the half-skirt element 13.

The second half-skirt element 13 consists of at least one second layer of material, separate and different from the first layer of material of the first trousers element.

The first trousers element 2 has substantially a form of a conventional type for those who are skilled in this sector. In the example here illustrated the trousers element 2 is for instance of a seamless type and consequently its front region 11, laterals regions 5A, B, rear region 7, and leg regions 8A and 8B consist each of one layer of fabric, and only in correspondence with the crutch of the trousers there is provided, as conventional for this type of seamless garments, a part or "patch" 10 that is sewn to the adjacent parts of the garment, as shown in FIG. 4.

However, the trousers element 2 might also consist, as as much usual for those skilled in this sector, of a plurality of pieces of fabric, having identical or different textile characteristics, manufactured separately and subsequently attached to each other by way of usual seams, for instance flat-locked seams. For instance, a pair of trousers might have a front part and a rear part sewn to each other along vertical lateral sewing lines (as discussed below with reference to another embodiment of the invention).

The trousers element 2 also advantageously includes a waistband part 16, also of a conventional type for those skilled in this sector, consisting of one or several parts sewn to each other, and suitable for holding the trousers attached to the wearer's waist. The waistband part 16 is attached, for instance by way of a sewing line 16A, to the regions (front region 11, rear region 7, and lateral regions 5A, B) of the trousers element 2 underneath.

The trousers element, as usual for those skilled in this sector, might even have an opening on the front, closed by a zip and/or by one or several buttons.

This first trousers element 2 is made at least one first layer of material, for instance a knitted fabric, more preferably an elastic knitted fabric. The fabric might for instance consist of a yarn including a natural fiber, for instance cotton, and a synthetic fiber, for instance fibers of the type known under the brand names: Lycra or Emana.

According to the invention, externally, above the first trousers element 2, and in correspondence with the region 7 of said element 2 that covers the buttocks, the garment comprises a second half-skirt element 13, suitable for forming a rear half-skirt, so as to cover and make the shape of the buttocks or at least of a part thereof less visible.

In the embodiment illustrated in FIGS. 1-4 this half-skirt element 13 is shaped and dimensioned so as to fully cover the complete rear part 7 of the trousers element 2, which in turn covers the buttocks, but, as discussed below, the half-skirt element might have smaller dimensions and be shaped and dimensioned so as to extend in width from one lateral part 6A (FIG. 5A) to the other lateral part 6B of the pelvis only, and in height so as to cover one central part F1 (FIG. 5B) of the buttocks only, that which features a greater roundness, and a lower terminal part F2 of the buttocks 1, and not also an upper part of the buttocks which remains covered by the trousers element. In any case the half-skirt element 13 never makes up a complete skirt nor does it also cover the front region 11 of the trousers element 2 suitable for covering the front part 3 of the pelvis.

Advantageously, the half-skirt element 13 develops along a section M of its own (FIG. 2) even below the rear crotch point P of the trousers element 2, so as also partly extend above the rear portion of the two regions 8A, 8B of the trousers element that cover the legs above.

This section M might have dimensions (as measured from the crotch point of the trousers element up to the lower edge 15 of the half-skirt element 13) ranging from 1 cm to 50 cm, more preferably from approximately 10 cm to 30 cm, so that the half-skirt element forms a rear half-skirt of the "mini" or "above the knee" type.

Advantageously is the half-skirt element 13 shaped and dimensioned so that its two extremal lateral regions 14A (FIG. 1) extend and also at least partially cover the lateral regions 5A, B of the trousers element 2, and certain lateral regions of the trousers that cover the hips 6A, B (FIG. 5A).

FIG. 3D shows the trousers element 2, the half-skirt element 13 having not been attached yet thereto. As shown in FIG. 3D the trousers element 2, which in this embodiment is realized as a seamless garment, presents in correspondence with each of its lateral regions 5A, B, in particular with the lateral regions suitable for covering the hips, a cut 18 wherein the lateral free edge 14 (FIG. 3E) of the half-skirt element 13 is inserted, such cut is then closed by a seam 24 (FIG. 3B) whereby the edge 14 of the half-skirt element is attached inside the trousers element. Thanks to this solution the half-skirt element 13 is sewn laterally to the trousers element 3 in a particularly pleasant way aesthetically wise.

Advantageously is the half-skirt element 13 sewn laterally to the underneath trousers element 2 by way of seams 24 (FIG. 3B, 3C) which feature a curved pattern, the concavity facing the front part of the trousers; this configuration of the seams imparts a hips-slenderizing effect to the garment when worn.

Obviously the lateral edge 14 of the half-skirt element 13 might be sewn directly above a respective lateral region 5A, 5B of the trousers element 2 without any need for having a lateral cut 18, even though this solution is preferred.

Preferably, in the half-skirt element 13 its upper edge 15A (FIG. 3E) is sewn to the trousers element 13, advantageously is this upper edge associated with the trousers element 2 in correspondence with the sewing line 16A that joins the upper band 16 and the rear part 7 of the trousers element 2 to each other. The edge 15A of the half-skirt element 13 is also preferably sewn to the trousers element 2 so that, once sewn, it is located inside the trousers element 2.

According to the invention the half-skirt element 13 is attached to the underneath trousers element 2 in correspondence with its lateral edges 14 (FIG. 3E) only, and preferably also in correspondence with its upper edge 15A (as described above), not in correspondence with its lower edge 15 or with a central portion 15B thereof. Therefore, the half-skirt element 13 does not completely cling to the buttocks when the garment is worn, nor is it fit to emphasize the shape of the glutei, but on the contrary it is suitable for masking their shape, or for masking the shape of those parts of the buttocks which are more rounded. The fact that the half-skirt masks the shape of the glutei is also, specifically, a consequence of the fact that the half-skirt 13 does not have a central seam suitable for attaching it to the rear central line 7A of the trousers element 2. The half-skirt extending over at least one section M of its own (FIG. 2) below the rear crotch point P also concurs to further mask the shape of the buttocks and of the glutei, which develop and/or might present a shape that not always is perceived as a graceful one, even partially below the rear crotch point P of the trousers.

It is worth emphasizing that the overall width L (FIG. 2) of the half-skirt 13 might be equal to or greater than its corresponding width L1 (FIG. 2) of the region immediately underneath of the trousers element. The difference between these two widths will determine a garment with an element 13 that forms a half-skirt more or less clinging to the underneath part 7 of the trousers element.

It is worth noting that the width L of the half-skirt element 13 might even be less than the width L1 of the underneath trousers element 2 should, for instance, the half-skirt element 13 be made of a textile material having elasticity characteristics greater than those of the trousers element 2.

It is worth emphasizing that whenever the garment is worn, between the rear region 7 of the trousers element that covers the buttocks and the half-skirt element 13 a gap J is always present and, whenever the trousers are not worn, the half-skirt 13 might at least partially be raised with respect to the underneath region 7 of the trousers element (as shown in FIG. 4).

It is also worth emphasizing that the lateral terminal parts 14A (FIG. 3E) of the half-skirt element 13 might have a width N more or less marked, consequently the half-skirt element might end just in correspondence with the lateral terminal regions of the buttocks or extend up to also at least partially covering the hips as shown in FIGS. 3A-C, and/or a front lateral portion of the pelvis, in any case the half-skirt element never extends into the front part 11 of the trousers, suitable for covering the central part 3 of the pelvis, so that this front part of the trousers element always remains visible; in this sense said half-skirt element is suitable for forming only a half-skirt above the trousers element, suitable for substantially covering the buttocks only or the buttocks and a portion of the hips, not a complete skirt.

Also, according to the invention the half-skirt element 13 has a height H (FIG. 2) that is preferably greater than or equal to the height H1 of that region 7 of the trousers which covers the buttocks, and/or more preferably the overall height H2 (FIG. 5C) of the buttocks.

It is worth emphasizing the fact that the half-skirt element 13 being firmly attached to the underneath trousers element 2 warranties that, whenever the garment is worn, this half-skirt element 13 is always perfectly and correctly positioned, both with respect to the underneath trousers element and with respect to that part of the body, i.e. the buttocks, which should be covered and masked by such half-skirt. Therefore, the garment is easily and simply wearable and there is no need, once it is worn, for positioning and/or adjusting the elements that make up it.

The half-skirt element 13 consists of at least one layer of a second material, distinct from the knitted fabric that the trousers element 13 is made of, for instance a knitted fabric, more preferably an elastic knitted fabric. The fabric might consist, for instance, of a yarn comprising a natural fiber, for instance cotton, and a synthetic fiber, for instance fibers of the types known under the brand names: Lycra or Emana.

As previously described, the half-skirt element can be shaped and dimensioned so as to extend in width only from a lateral part 6A (FIG. 5A) to the other lateral part 6B of the pelvis, and in height so as to only cover a central part F1 (FIG. 5B) of the buttocks, that which features a greater roundness, and a lower terminal part F2 of the buttocks 1, not also an upper zone of the buttocks. In FIG. 3A the broken line 16A' shows the upper edge of the half-skirt 13' according to this variant and the reference numeral 7' shows that part of the trousers element which is suitable for covering the upper part of the buttocks that is not covered by the half-skirt. Still with reference to this figure, the reference H shows the total height of the buttocks, the reference H2 shows the maximum height of the half-skirt 13' according to the variant under consideration, and the reference H3 shows the height of the band 7' of the trousers element suitable for covering the upper terminal part of the buttocks.

Figure 6C:
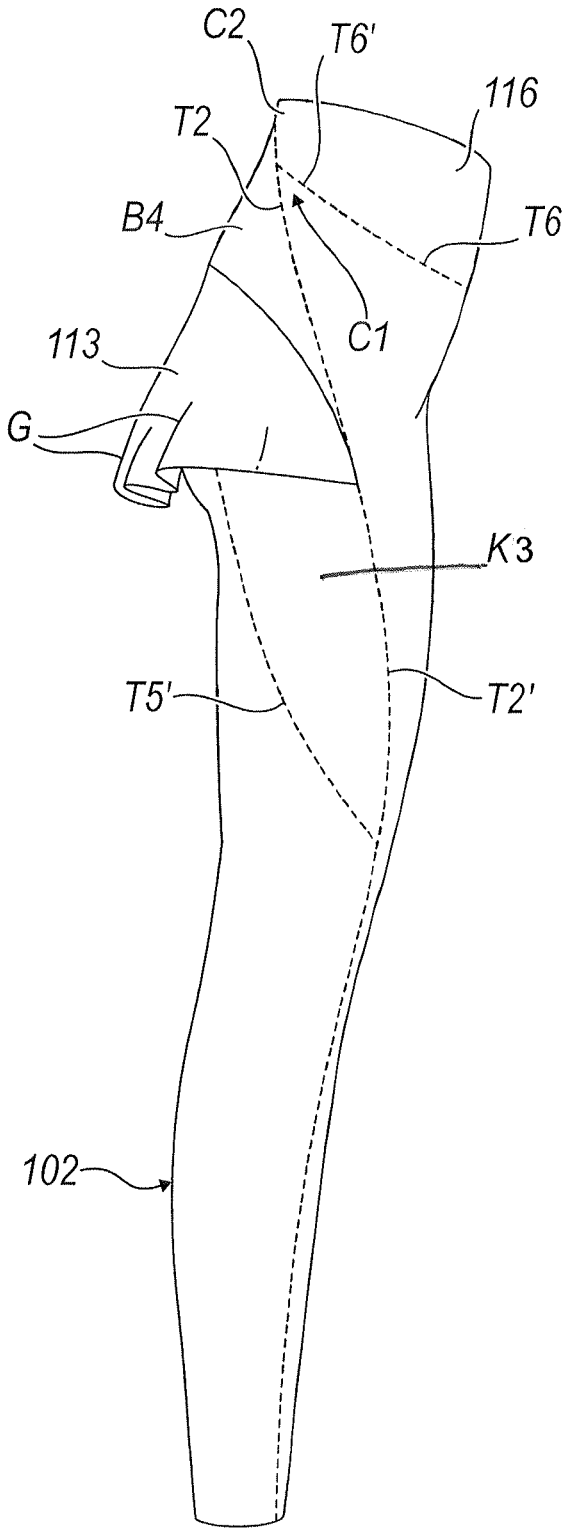
Figure 8B:
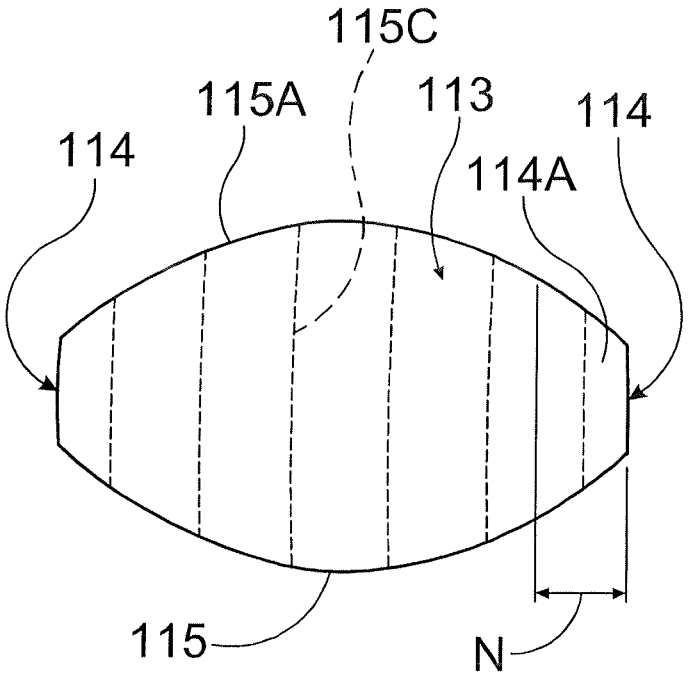

FIGS. 6-8 illustrate a second embodiment of a garment according to the invention; the elements that are common to the first embodiment as illustrated in FIGS. 1-4 will not be further described and will be referred to by the same reference numerals used for the garment according to FIGS. 1-4, but increased by 100.

According to this variant, the garment still comprises a first trousers-shaped element 102, and, externally thereto, above the first trousers element 102 and in correspondence with the region 107 of said element 102 that covers the buttocks, a second half-skirt element 113, suitable for forming a rear half-skirt, so as to cover and make the shape of the central zone F1 (FIG. 5B) of the buttocks featuring a greater roundness and of the lower terminal zone F2 of the buttocks, less visible. According to this variant, the half-skirt element 113 does not cover the upper zone F3 (FIG. 5B) of the buttocks, which remains covered by the trousers element 102 only.

According this variant, preferably is the half-skirt element 113 dimensioned and/or shaped in such a way as to form a plurality of pleats G, hence in such a way as not to cling to the underneath part of the trousers element. These pleats G are realized in a way that is conventional for those skilled in the sector, for instance by dimensioning the element 113 so that its upper edge 115A (FIG. 8B) has a length greater than that of the lower edge 115, or by providing a plurality of seams 115C (broken line in FIG. 8B) in the half-skirt element, suitable for realizing said pleats.

The trousers element 102 according to this second embodiment might for instance be obtained by sewing a plurality of separate parts to each other, each formed of one or several pieces of fabric, so as to give a more close-fitting shape to the trousers and make it better cling to the various parts of the body.

The trousers element 102 comprises, for instance, a front region 111 capable of covering at least the front zone 3 (FIG. 5A) of the pelvis 4, a rear region 107 (FIG. 3D) suitable for covering the buttocks 1, two lateral regions 105A, B suitable for positioning in and covering each a zone S substantially extending from a lateral part 6A, B of the pelvis to a lateral terminal zone Z1, Z2 of the buttocks, two lower regions 108A, 108B suitable for separately covering each at least an upper zone 9 of the legs, and a crotch region 110 interconnecting said two lower regions 8A, 8B.

In the example here illustrated, the trousers element 102 is for instance of a type comprising a plurality of pieces of fabric sewn to each other (for instance by way of flat-locket seams), but said trousers element 102 might also be obtained by using other construction techniques conventional for those skilled in the sector and be for instance realized with no seams as with the garment described in the previous embodiment.

Should the trousers element be formed of a plurality of pieces of fabric sewn to each other, then the crotch part of the trousers element might just be formed of a seam.

According to the invention a trousers element comprising the special seams described below makes it possible to model the figure of a wearer and to improve his/her look, even though the trousers element is used without a half-skirt element.

Therefore, a trousers element with no half-skirt and comprising the following component parts also falls into the scope of protection of the present invention:

in the front region:

a front waistband part 116 (FIG. 6A) which extends to and covers an upper band of the front region 111 of the trousers that covers the pelvis and two portions C2 (FIG. 6B) of the upper rear region of the trousers that covers the terminal upper band of the buttocks, two front parts 108A, B which extend to and cover the front region 111 of the trousers in correspondence with the pelvis, below the front waistband part 116, up to the crutch, and also cover the front parts of the legs, these two front parts also comprising the portions C1 (FIG. 6B) that extend in the lateral rear part of the trousers in correspondence with the sides and of the most extremal lateral part S (FIG. 5C) of the buttocks wherein said front waistband part 116 and said two front parts 108A and B are sewn to each other by an arched front seam T6 whose concavity faces the upper edge of the trousers so as to flatten the look of this upper part of the pelvis, and said two front parts 108A and B are sewn to each other by a seam T8 which centrally joins, in correspondence with the pelvis, the parts 108A and B to each other and departs from said front seam 116 and ends in the crutch point 110 (FIG. 8A), and in the rear part:

an upper rear part K1 which extends to and covers a flapper upper part F3 (FIG. 5B) only of the buttocks and is preferably formed of a plurality of parts B1-B4 sewn to each other, so as to better cling to said upper part of the buttocks, a lower part K2 which extends to and covers a more rounded central part F1 (FIG. 5B) only of the buttocks and a lower part F2 thereof, and then extends below with the parts 108A' and 108B' so as to cover a rear part of the legs, and two lateral parts K3 (FIGS. 6C and 8A) which extend to and cover each a more rounded lateral part of the buttocks, a rear lateral portion and a front lateral portion of the legs;

wherein an arched transversal seam 179 (FIG. 8A) having a concavity facing the legs of the trousers is dimensioned and shaped so as to surround above the more rounded part F of the buttocks and to join the two rear parts K1 and K2 to each other as well as the rear terminal portions of the parts K3 (FIG. 8A), wherein the seams T1-T5 join to each other the plurality of elements B1-B4 that form the rear upper part K1 of the trousers element, wherein a seam T3' joins the parts K2 and the parts K3 to each other behind.

The trousers element also preferably comprises seams 171C and T2' (FIG. 6 A) which join the zones that cover the legs of the parts 108B and 108A and 108B' and 108A' that cover these parts of the body; let's highlight that advantageously are the seams T2' that join the most external edges of the parts 108B and 108A and 108B' and 108A' shifted in the front part of the trousers element so as to slenderize the figure of the trousers wearer, and that, upon reaching the pelvis, these seams continue in the rear part of the trousers with their sections T2

The trousers element also comprises, in the rear part, lower seams T7 suitable for better making the trousers cling to in correspondence with the calves.

Preferably are the seams T3-T5 and T6' and T6 flat zig zag seams, so that the trousers better cling to the wearer's body in correspondence with these seams and thus not cause irritations.

Preferably are the seams 180 T2', T5 straight flat seams, which slenderize the figure and are suitable for making the trousers better cling to the wearer's body.

The remaining seams are preferably of a conventional type.

As described above, the rear part 107 of the trousers is for instance subdivided into two parts K1 and K2 (FIG. 8A), the upper part K1 is shaped and dimensioned so as to be suitable for covering a flatter upper portion F3 (FIG. 5B) of the buttocks, the lower part K2 is shaped and dimensioned so as to be suitable for covering a more rounded central part F1 (FIG. 5B) of the buttocks and a lower portion F2 of thereof.

The two parts K1 and K2 are joined to each other for instance by an arched transversal seam 179 (FIG. 8) having a concavity facing the legs of the trousers; such arched seam is dimensioned and shaped so as to surround the more rounded part F of the buttocks above.

The upper part K1 of the rear part 107 is for instance formed of a plurality of elongated vertically-developing elements, preferably four elements 175 (FIG. 8) attached to each other by seams T3-T5, also featuring a vertical development. Advantageously are the most external elongated elements B1 and B4 sewn to the offshoots C1 and C2 of the front elements 116 and 108A and B that cover the pelvis so as to form an upper rear band K1.

Thanks to this special configuration, the region K1 is suitable for following in an optimum manner the configuration of the flatter upper part of the buttocks and for slenderizing the external look of this upper part of the buttocks.

The lower region K2 of the rear part 107 of the trousers element also includes a central seam 178, which advantageously is an extension of the seam T4 of the upper rear part K1. Advantageously, the seam T3' also connects to the seam T3 of the upper part K12 of the rear upper part of the trousers.

As already discussed, the trousers element 2 also advantageously includes a waistband part 116 also of a conventional type for those skilled in this matter, consisting of one or several parts sewn to each other and suitable for holding the trousers attached to the wearer's waist. Advantageously, this waistband part 116 develops in the front part only of the trousers element 102.

The trousers element, as usual for those skilled in this sector, might also have an opening on the front, closed by a zip and/or by one or several buttons.

The various parts that make up the trousers element 102 consist of at least one first layer of material, for instance a knitted fabric, more preferably an elastic knitted fabric. The fabric might for instance consist of a yarn comprising a natural fiber, for instance cotton, a synthetic fiber, for instance fibers of the type known under the brand names: Lycra or Emana.

Preferably the half-skirt element 113 has its own arched upper edge 115A (FIG. 8B) with a concavity facing the legs of the trousers; such arched edge is dimensioned and shaped in such a way as to surround the more rounded part F of the buttocks above.

Preferably the half-skirt element 113 has its own lower edge 115 (FIG. 8B) also arched but with a concavity opposed to that of the upper edge 115A.

Advantageously, the half-skirt element 113 also develops along a section M (FIG. 6B) thereof, below the crotch point P of the trousers element 102, so as to also extend above the rear portions of the two parts 108A, 108B of the trousers element that cover the legs above. Such section M might be dimensioned exactly as the section M of the previously described half-skirt element 13, wherein the dimensions of said section M, as measured from said crotch point P to the lower edge 115 of the half-skirt element 113, range from 1 cm to 60 cm, preferably from approximately 10 cm to 30 cm, and more preferably from approximately 5 cm to 20 cm.

Advantageously is the half-skirt element 113 shaped and dimensioned so that its two extremal lateral portions 114A (FIG. 6A) extend in and at least partially also cover the front lateral regions 105 of the trousers element 102, but not also the front central region 111 of the trousers element which remains consequently visible when the garment is worn. In the garment according this variant the half-skirt element 113, suitable for forming a rear half-skirt, has its own arched upper edge 115A (FIG. 8B) attached to the rear part 107 of the underneath trousers element 102, by way of an arched transversal seam 180 (FIG. 7) which substantially follows the shape of the edge 115A and consequently also features a concavity facing the legs of the trousers and is dimensioned and shaped so as to surround the more rounded part F of the buttocks above.

Preferably, as shown in FIGS. 6-8, this arched seam 180 also coincides with the seam 179 (FIG. 8A) of the trousers element 102 which joins the upper region K1 and the lower region K2 of the rear part 107 of the trousers element, which covers the buttocks.

Advantageously, the half-skirt element 113 also has lateral edges 114 (FIG. 8B) that are attached to the trousers element, such edges being inserted in a section Y (FIG. 6A) of the lateral vertical seams T2' (FIG. 6A) of the trousers element 102.

Therefore, advantageously the half-skirt element 113 has portions 114A (FIG. 6A) of its own that at least partly develop into the lateral parts 105A, B of the trousers, but not also into its central front part 111, which consequently remains visible.

Such configuration of the half-skirt is suitable for modelling the trousers wearer's figure and for creating an improvement effect in the buttocks look.

Whenever the garment is worn, the half-skirt element 113 does not completely cling to the buttocks nor is it such as to emphasize the shape of the glutei, but on the contrary it is suitable for masking the shape, i.e. for masking the shape of the more rounded parts of the buttocks.

According to this variant, the half-skirt element being flared or pleated has a part U (FIG. 7) of its own suitable for remaining, when the garment is worn, spaced away from at least one lower region of the trousers element that covers the portion F1 of the buttocks having a greater roundness.

The fact that the half-skirt masks the shape of the glutei is also, in particular, a consequence of the fact that the half-skirt element 113 does not have a central seam suitable for attaching it to the underneath rear seam 178 (FIG. 8) of the trousers element 102. In addition, also the fact that the half-skirt extends along at least a section M (FIG. 6B) thereof below the crotch point P concurs to further mask the shape of the buttocks and of the glutei, which develop and/or might present a shape not always perceived as graceful, even partially below the rear crotch point P of the trousers.

It is worth emphasizing that, whenever the garment is worn, between the rear part 107 of the trousers element that covers the buttocks and the half-skirt element 113 there is always a gap similar to that referred to by the letter J in FIG. 4, and whenever the trousers are not worn the half-skirt element 113 can consequently be at least partially raised with respect to the underneath part 107 of the trousers element.

It is also worth emphasizing that the lateral terminal parts 114A (FIG. 8B) of the half-skirt element 113 might have a width N more or less marked, consequently the half-skirt element might end exactly in correspondence with the lateral terminal portions of the buttocks or extend up to also at least partially covering a lower portion of the hips as shown in FIG. 7, in any case the half-skirt element does not extend into the front central region 111 of the trousers, and in this sense said half-skirt element is suitable for forming just a half-skirt above the trousers element suitable for substantially covering the buttocks only or the buttocks and a portion of the hips.

It is worth emphasizing that the fact that the half-skirt element 113 being firmly attached to the underneath trousers element 102 warranties that, whenever the garment is worn, this half-skirt element 113 is always perfectly and correctly positioned, both with respect to the underneath trousers element and with respect to that part of the body, i.e. the buttocks, that such half-skirt shall cover and mask. Therefore, the garment is easily and simply wearable and does not need, once it is worn, to position and/or adjust the elements that make up it.

The half-skirt element 113 consists of at least one layer of the second material, distinct from the knitted fabric that the underneath trousers element is made of, for instance a knitted fabric, more preferably an elastic knitted fabric. The fabric might for instance consist of a yarn comprising a natural fiber, for instance cotton, and a synthetic fiber, for instance a fiber of the types known under the brand names: Lycra or Emana.

FIGS. 9A and B show a third embodiment of a garment according to the invention; the elements common to the first embodiment as illustrated in FIGS. 1-4 will not be further described and will be referred to by the same reference numerals as used for the garments illustrated in FIGS. 1-4 but increased by 200.

According to this variant, the garment still includes a first trousers-shaped element 202 and, externally thereto, above the first trousers-shaped element 202 and in correspondence with the part 207 of said element 202 that covers the buttocks, a second half-skirt element 213, suitable for forming a rear half-skirt, so as to cover and render the shape of the buttocks less visible. However, according to this variant, the trousers element 202 also includes a singlet element 290, forming one piece with said trousers element, suitable for at least partially covering the chest and the back.

According to this variant, the half-skirt element 213 is shaped and dimensioned so as to fully cover the rear part 207 of the trousers element that covers the buttocks.

Preferably is the half-skirt element 213 dimensioned and shaped so as to realize a half-skirt that features a plurality of pleats G.

Preferably is the half-skirt element 213 dimensioned and shaped so as to realize a "flared" half-skirt.

These pleats G are realized in a conventional manner for those skilled in this sector, for instance by dimensioning the element 213 so that the upper edge features a length greater than that of the lower edge, or by providing a plurality of seams 215C (shown in broken lines in FIG. 9B) in the half-skirt element, suitable for realizing such pleats.

Alternatively, the half-skirt element 213 might even be dimensioned and shaped so as to realize a half-skirt clinging to the underneath part 207 of the trousers element, i.e. a clinging half-skirt element of the type shown in FIGS. 1-3.

The trousers element 202 and the singlet element 290 according to this embodiment might be realized in a conventional manner whatsoever for those skilled in this sector, for instance by sewing a plurality of pieces of fabric to each other, so as to shape the trousers and the singlet more and make it better cling to the various parts of the body. For this purpose, the trousers element 202 includes, for instance, a front part 211 suitable for at least covering the front part 3 (FIG. 1) of the pelvis 4, a rear part 207 (FIG. 3D) suitable for covering the buttocks 1, two lower parts 208A, B suitable for separately covering each at least an upper part 9 of the legs, two lateral parts 205A, B suitable for positioning in and covering each a region S substantially extending from a lateral part 6A, B of the pelvis to a lateral terminal part Z1, Z2 of the buttocks, and a crotch part 210 interconnecting said two lower parts 208A, B.

In the example here shown is the trousers element 202 for instance of a type including a plurality of pieces of fabric sewn to each other (for instance by way of flat-locked seams), but said trousers element 202 might also be realized according to other construction techniques that are conventional for those skilled in this sector and, for instance, be realized of a seamless type, in a way similar to what described with reference to the previous embodiment.

For merely explanatory, but not limitative, purposes, FIGS. 9A-B highlight and identify with the reference numerals 271A-C and 272 A-D some of possible sewing lines of the various pieces of fabric that make up the trousers element 202 and the singlet element 290. The various parts that make up the trousers element 202 consist of at least one first layer of material, for instance a knitted fabric, more preferably an elastic knitted fabric. The fabric might for instance consist of a yarn comprising a natural fiber, for instance cotton, and a synthetic fiber, for instance fibers of the types known under the brand names: Lycra or Emana.

Preferably, the half-skirt element 213 has its own arched upper edge 215A (FIG. 9B) with a concavity facing the legs of the trousers; such arched edge is dimensioned and shaped so as to surround the upper terminal part V (FIG. 5B) of the buttocks above.

Preferably, the half-skirt element 213 has its own lower edge 215 (FIG. 9) also arched, but with a concavity opposite to that of the upper edge 215A and facing the center of the buttocks.

Advantageously, the half-skirt element 213 develops along a section M (FIG. 9B) of its own also below the rear crotch point P of the trousers element 202, so as to also partially extend above rear portions of the two parts 208A, 208B of the trousers element that cover the legs above.

This section M might be dimensioned exactly as the section M described with reference to the half-skirt element 13.

Also, according to the invention the half-skirt element 213 has a height H (FIG. 9B) that is preferably greater than or equal to the height H1 of that part of the trousers that covers the buttocks and/or the overall height H2 (FIG. 5C) of the buttocks. As with the previous embodiments, also for this one it is worth emphasizing that the half-skirt element might also feature a height H6 (FIG. 9B) lower than the above mentioned height H and be consequently capable of covering a central part F1 (FIG. 5B) only of the buttocks, featuring a greater roundness, and a lower terminal part F2 of the buttocks 1, and not also an upper zone of the buttocks. According to this variant the trousers element includes a part suitable for covering the upper part of the buttocks that is not covered by the half-skirt. Advantageously is the half-skirt element 213 shaped and dimensioned so that its two extremal lateral parts 214A (FIG. 9A) extend in and also at least partially cover the lateral parts 205A, B of the trousers element 202, and in particular the lateral parts that cover the hips 6.

In the garment according to this variant, the half-skirt element 213 suitable for forming a rear half-skirt has its own arched upper edge 215A (FIG. 9B) attached to the underneath rear part 207 of the trousers element 202, by way of an arched transversal seam 280 (FIG. 9B), which consequently also features a concavity facing the legs of the trousers and is dimensioned and shaped so as to surround the upper terminal part V of the buttocks above. Advantageously, the half-skirt element 213 also includes lateral edges 214 (FIG. 9B) which are attached to front lateral parts 205 of the trousers element, such edges being for instance inserted in a section of the lateral vertical seams 271B and 271A (FIG. 9B) of the trousers element 202.

Consequently, advantageously the half-skirt element 213 has portions 214A of its own that at least partially develop into the front lateral parts 205 of the trousers, but without also covering the central front part 211 which remains covered by the trousers element only.

When the garment is worn, the half-skirt element 213 does not completely cling to the buttocks, nor is it such as to emphasize the shape of the glutei, but on the contrary it is suitable for masking the shape of the buttocks. The fact that the half-skirt masks the shape of the glutei is also, in particular, a consequence of the fact that the half-skirt element 213 does not have a vertical central seam suitable for attaching it to an intergluteal rear central seam of the trousers element 202. Furthermore, also the fact that the half-skirt extends below the rear crotch point P along at least a section M (FIG. 9B) thereof concurs to further mask the shape of the buttocks and of the glutei, which develop and/or might present a shape not always perceived as graceful, even partially below the rear crutch point P of the trousers.

It is worth emphasizing that whenever the garment is worn, between the rear part 207 of the trousers element that covers the buttocks and the half-skirt element 213 there is always present a gap of the type referred to by the letter J in FIG. 4, and whenever the trousers are not worn the half-skirt element 213 might be at least partially raised with respect to the underneath part 207 of the trousers element.

It is also worth emphasizing that the lateral terminal parts 214A (FIG. 9B) of the half-skirt element 213 might have a width N more or less marked, consequently the half-skirt element might end exactly in correspondence with the lateral terminal portions of the buttocks or extend up to also at least partially covering a front lateral portion 205A, B of the trousers element, for instance a lateral portion provided in correspondence with the hips, as shown in FIG. 9A, in any case the half-skirt element does not extend into the central front part 211 of the trousers, and in this sense said half-skirt element is suitable for forming only a half-skirt above the trousers element, suitable for substantially covering the buttocks only or the buttocks and the portion of the hips, but not also the front part 211 of the trousers element which remains covered by the trousers element only.

It is worth emphasizing that the fact that the half-skirt element 213 being firmly attached to the underneath trousers element 202 warranties that, whenever the garment is worn, this half-skirt element 213 is always perfectly and correctly positioned, both with respect to the underneath trousers element and with respect to that part of the body, i.e. the buttocks, that shall be covered and masked by such half-skirt. Therefore, the garment is easily and simply wearable and does not require, once it is worn, to position and/or adjust the elements that make up it.

The half-skirt element 213 consists of at least one layer of a second material, distinct from the knitted fabric that the trousers element 13 is made of, for instance a knitted fabric, more preferably an elastic knitted fabric. The fabric might for instance consist of a yarn comprising a natural fiber, for instance cotton, and a synthetic fiber, for instance fibers of the types known under the brand names: Lycra or Emana.

FIGS. 10A and B show a fourth embodiment of a garment according to the invention; the elements common to the first embodiment as illustrated in FIGS. 1-4 will not be further described and will be referred to by the same reference numerals as used for the garments illustrated in FIGS. 1-4 but increased by 300.

According to this variant, the garment still includes a first trousers-shaped element 302, and, externally thereto, above the first trousers-shape element 302, and in correspondence with the part 307 of said element 302 that covers the buttocks, a second half-skirt element 313, suitable for forming a rear half-skirt, so as to cover and render the shape of the buttocks less visible. However, according to this variant, the trousers element 302 is of a "shorts" type, i.e. trousers wherein the dimensions of the portions 308A and 308B where the legs pass through are extremely reduced.

According to this variant, the half-skirt element 313 is shaped and dimensioned so as to fully cover the rear part 307 of the trousers element that covers the buttocks.

Preferably is the half-skirt element 313 dimensioned and shaped so as to realize a half-skirt that features a plurality of pleats G.

Preferably is the half-skirt element 313 dimensioned and shaped so as to realize a "flared" half-skirt.

These pleats G are realized in a conventional manner as discussed for the variants according to FIGS. 9 and 6. Alternatively, the half-skirt element 313 might even be dimensioned and shaped so as to realize a half-skirt clinging to the part 307 of the underneath trousers element, i.e. a clinging half-skirt element of the type shown in FIGS. 1-3.

The trousers element 302 according to this embodiment might be realized in a conventional manner whatsoever for those skilled in this sector, for instance by sewing a plurality of pieces of fabric to each other, so as to shape the trousers and the singlet more and make it better cling to the various parts of the body. For this purpose, the trousers element 302 includes, for instance, a front part 311 suitable for at least covering the front part 3 (FIG. 1) of the pelvis 4, a rear part 307 (FIG. 3D) suitable for covering the buttocks 1, two lower parts 308A, B suitable for separately covering each at least an upper part 9 of the legs, two lateral parts 305A, B suitable for positioning in and covering each a region S substantially extending from a lateral part 6A, B of the pelvis to a lateral terminal part Z1, Z2 of the buttocks, and a crutch part 310 interconnecting said two lower parts 308A, B.

In the example here shown is the trousers element 302, for instance, of a type including a plurality of pieces of fabric sewn to each other (for instance by way of flat-locked seams), but said trousers element 302 might also be realized according to other construction techniques that are conventional for those skilled in this sector and, for instance, be realized of a seamless type, in a way similar to what described with reference to the previous embodiment.

For merely explanatory, but not limitative, purposes, FIGS. 10A-B highlight and identify with the reference numerals 371A-C and 372A some of possible sewing lines of the various pieces of fabric that make up the trousers element 302.

The various parts that make up the trousers element 302 consist of at least one first layer of material, for instance a knitted fabric, more preferably an elastic knitted fabric. The fabric might for instance consist of a yarn comprising a natural fiber, for instance cotton, and a synthetic fiber, for instance fibers of the types known under the brand names: Lycra or Emana.

Preferably, the half-skirt element 313 has its own arched upper edge 315A (FIG. 10B) with a concavity facing the legs of the trousers; such arched edge is dimensioned and shaped so as to surround the upper terminal part V (FIG. 5B) of the buttocks above.

Preferably, the half-skirt element 313 has its own lower edge 315 (FIG. 8) also arched, but with a concavity opposite to that of the upper edge.

Advantageously, the half-skirt element 313 develops along a section M (FIG. 9B) of its own also below the rear crutch point P of the trousers element 302, so as to also partially extend above rear portions of the two parts 308A, 308B of the trousers element that cover the legs above. This section M might be dimensioned exactly as the section M described with reference to the half-skirt element 13.

This section M might be dimensioned exactly as the section M described with reference to the half-skirt element 13.

Also, according to the invention the half-skirt element 313 has a height H (FIG. 10B) that is preferably greater than or equal to the height H1 of that part of the trousers that covers the buttocks and/or the overall height H2 (FIG. 5C) of the buttocks. As with the previous embodiments, also for this one it is worth emphasizing that the half-skirt element might also feature a height H7 (FIG. 10B) lower than the above mentioned height H and be consequently capable of covering a central part F1 (FIG. 5B) only of the buttocks, featuring a greater roundness, and a lower terminal part F2 of the buttocks 1, and not also an upper zone of the buttocks. According to this variant the trousers element includes a part suitable for covering the upper part of the buttocks that is not covered by the half-skirt. Advantageously is the half-skirt element 313 shaped and dimensioned so that its two extremal lateral parts 314A (FIG. 9A) extend in and also at least partially cover the lateral parts 305A, B of the trousers element 302 that cover the hips 6, but without also covering the front central part 311 of the trousers element which remains visible when the garment is worn.

In the garment according to this variant, the half-skirt element 313 suitable for forming a rear half-skirt has its own arched upper edge 315A (FIG. 10A) attached to the underneath rear part 307 of the trousers element 302, by way of an arched transversal seam 380 (FIG. 9B), which consequently also features a concavity facing the legs of the trousers and is dimensioned and shaped so as to surround the upper terminal part V of the buttocks above. Advantageously the half-skirt element 313 also includes lateral edges 314 (FIG. 10B) which are attached to the trousers element, such edges being for instance inserted in a section of the lateral vertical seams 371B and 371A (FIG. 9B) of the trousers element 302.

According to this embodiment, an upper section R (FIG. 10B) of the lateral edges 314 is attached to the rear part 307 of the trousers element whereas the remaining lower section is attached to the lateral front part 305 of this trouser element. Such configuration is suitable for slenderizing the figure of the trousers' wearer.

Therefore, advantageously the half-skirt element 313 has portions 314A of its own that at least partially develop in the lateral front part 305A, B of the trousers, for instance in that part of the trousers element that covers the hips.

When the garment is worn, the half-skirt element 313 does not completely cling to the buttocks, nor is it such as to emphasize the shape of the glutei, but on the contrary it is suitable for masking the shape or for masking the shape of those parts of the buttocks which are more rounded. The fact that the half-skirt masks the shape of the glutei is also, in particular, a consequence of the fact that the half-skirt element 313 does not have a vertical central seam suitable for attaching it to the intergluteal rear central line of the trousers element 302. Furthermore, also the fact that the half-skirt extends below the rear crutch point P along at least a section M (FIG. 10B) thereof concurs to further mask the shape of the buttocks and of the glutei, which develop and/or might present a shape not always perceived as graceful, even partially below the rear crutch point P of the trousers.

It is worth emphasizing that whenever the garment is worn, between the rear part 307 of the trousers element that covers the buttocks and the half-skirt element 313 there is always present a gap of the type referred to by the letter J, and whenever the trousers are not worn the half-skirt element 313 might be at least partially raised with respect to the underneath part 307 of the trousers element.

It is also worth emphasizing that the lateral terminal parts 314A (FIG. 10B) of the half-skirt element 313 might have a width N more or less marked, consequently the half-skirt element might end exactly in correspondence with the lateral terminal portions of the buttocks or extend up to also at least partially covering a front lateral portion 305A, B, for instance a lower portion of the hips, as shown in FIG. 10B, in any case the half-skirt element does not extend into the central front part 311 of the trousers, and in this sense said half-skirt element is suitable for forming only a half-skirt above the trousers element, suitable for substantially covering the buttocks only or the buttocks and a front lateral portion 305A, B, for instance in correspondence with the hips.

It is worth emphasizing that the fact that the half-skirt 213 being firmly attached to the underneath trousers element 302 warranties that, whenever the garment is worn, this half-skirt element 313 is always perfectly and correctly positioned, both with respect to the underneath trousers element and with respect to that part of the body, i.e. the buttocks, that shall be covered and masked by such half-skirt. Therefore, the garment is easily and simply wearable and does not require, once it is worn, to position and/or adjust the elements that make up it.

The half-skirt element 313 consists of at least one layer of a second material, distinct from the knitted fabric that the trousers element 13 is made of, for instance a knitted fabric, more preferably an elastic knitted fabric. The fabric might for instance consist of a yarn comprising a natural fiber, for instance cotton, and a synthetic fiber, for instance fibers of the types known under the brand names: Licra or Enama.

It is finally worth pointing out that the embodiments illustrated so far have been provided for explanatory purposes and numerous variants are possible, all of them falling within the same invention concept. For instance, in the various types of trousers elements illustrated so far, it is possible to associate any of the various types of half-skirt elements illustrated so far. For instance, with the trousers element 2 according to FIGS. 1-3 it would be possible to associate, in addition to the half-skirt element 13, of a clinging type, shown in FIGS. 1-3, also a half-skirt element of a flared and/or pleated type, as shown in FIGS. 9 and 10 or even the half-skirt element suitable for only covering the more rounded central part and the lower part of the buttocks, as shown in FIGS. 6-8. The same holds true also for the remaining trousers elements illustrated so far and for the various half-skirt elements described so far.

It is also worth emphasizing that also the half-skirt elements suitable for forming a rear half-skirt illustrated so far have been provided for explanatory purposes only, therefore such half-skirt element might be shaped according to any of the known types of a skirt, usual for those skilled in this sector, for instance, the half-skirt element might be shaped so as to form a rear half-skirt not only of the clinging, flared, or pleated type, but also, for instance, of a flounce, tube, ruched, plissé, wrapover, or balloon skirt.

Similar considerations also apply to the configuration of the trousers element which might have any conventional shapes for those skilled in this sector, in particular the length of the part suitable for covering the legs might be of any type so as to realize trousers elements for instance of the short, long, below the knee, above the knee, half-thigh types, and so on. Likewise, the garment might be of any known type comprising a trousers element, provided it is suitable for being worn and being visible from the outside, i.e. not an underwear. Therefore, the garment also comprises salopettes and sleeved or sleeveless one-piece suits.

As already indicated above, a scope of this invention is also a piece of trousers with no half-skirt and with its rear part suitable for covering the buttocks shaped as illustrated in FIG. 8A, in particular shaped in such a way as to present a waistband K1 that covers the upper part of the buttocks, structured by joining a plurality of elongated elements B1-B4 sewn to each other by way of vertically-developing seams T1-T5 and a underneath waistband K2 joining to the band K1 by way of an arched transversal seam 179 (FIG. 8A) having a concavity facing the legs of the trousers and dimensioned and shaped so as to surround the more rounded part F of the buttocks above.

The invention claimed is:

1. A garment for outdoor use, for at least partially masking a shape of a buttocks of a wearer, comprising:

a trousers element of at least one first layer of material, including:

a front region adapted to position in and adapted to at least partially cover a central front part of a pelvis, two lateral regions adapted to position in and adapted to cover each a body portion substantially extending from a lateral part of the pelvis to a lateral terminal part of the buttocks, a rear region adapted to position in and adapted to cover the buttocks, two lower regions adapted to position in and adapted to separately cover each at least an upper part of a leg, and a crotch region interconnecting at least said two lower regions; and a half-skirt element adapted to form a rear half-skirt above said trousers element, wherein said half-skirt element is shaped and dimensioned:

to transversally extend only from one of said two lateral regions of the trousers element to another of the two lateral regions, and for at least covering a central part of the buttocks featuring a greater roundness than an upper part of the buttocks situated immediately above the central part of the buttocks and for at least covering a lower terminal part of the buttocks situated immediately below the central part of the buttocks, while leaving free and visible the front region of the trousers element suitable for covering the central front part of the pelvis, wherein said half-skirt element is delimited: laterally by lateral extremal edges, above by an upper extremal edge, and below by a lower extremal edge, said lateral extremal edges being firmly attached each to a section of one of the two lateral regions of the trousers element underlying the lateral extremal edge, said lower extremal edge not being attached by the trousers element underlying the lower extremal edge, said half-skirt element of at least one second layer of material, separate and distinct from said at least one first layer of material of the trousers element, wherein said half-skirt element is shaped and dimensioned for covering the central part of the buttocks and the lower terminal part of the buttocks, but not also for covering the upper part of the buttocks, said half-skirt element leaving free and visible a portion of the trousers element for covering said upper part of the buttocks;

wherein the upper extremal edge of the half-skirt is provided at the central part of the buttocks and the half-skirt element is shaped and dimensioned for not covering the upper part of the buttocks situated immediately above the central part of the buttocks.

2. A garment according to claim 1, wherein the half-skirt element is shaped and dimensioned for covering the central part of the buttocks but not also for covering the upper part of the buttocks so and not also for covering an upper part of an intergluteal cleft of the buttocks, wherein the rear region of the trousers element has a lower region, a central region, and an upper region adapted to position in and adapted to cover respectively the lower terminal part, the central part, and the upper part of the buttocks, wherein the half-skirt covers the lower region and the central region of the rear region of the trousers element, but not the upper region of the rear region of the trousers element.

3. A garment according to claim 1, wherein the half-skirt element comprises a lower section which extends downwards below the crotch region of the trousers element.

4. A garment according to claim 1, wherein the half-skirt element comprises a lower section which extends downwards below the crotch region so said half-skirt element also covers at least one section of the two lower regions of the trousers element adapted to cover the upper part of the legs, such that the lower section of the half-skirt element is adapted to cover at least the lower terminal part of the buttocks and adapted to cover at least an initial portion of the upper part of the legs.

5. A garment according to claim 1, wherein the half-skirt element comprises a lower section which extends downwards below the crotch region, said lower section having dimensions, as measured from said crotch region to the lower extremal edge of the half-skirt element, ranging from 1 cm to 60 cm.

6. A garment according to claim 1, wherein the half-skirt element is attached to the trousers element underlying the half-skirt element only in correspondence with the lateral extremal edges and with the upper extremal edge of the half-skirt element.

7. A garment according to claim 1, wherein the half-skirt element is shaped to form the rear half-skirt of one of the following types:

a band half-skirt adapted for at least clinging to an underlying portion of the rear region of the trousers element adapted to cover the central part of the buttocks whenever the garment is worn, or a flared or pleated half-skirt having at least one part thereof adapted to remain spaced away from at least one of the lower regions of the trousers element adapted to cover the central part of the buttocks when the garment is worn.

8. A garment according to claim 1, wherein the half-skirt element includes a plurality of pleats suitable for holding the at least one second layer of material of the half-skirt element spaced away from the at least one first layer of material of the trousers element underlying the at least one second layer of material of the half-skirt element when the garment is worn.

9. A garment according to claim 1, wherein the upper extremal edge of the half-skirt element comprises an arched upper edge with a concavity facing the lower regions of the trousers element; wherein the arched upper edge being dimensioned and shaped for surrounding the central part of the buttocks and for covering the rear region of the trousers element underlying the half-skirt element.

10. A garment according to claim 1, wherein a gap exists between the rear region of the trousers element that is adapted to cover the buttocks and the half-skirt element that is arranged over the rear region of the trousers element, said gap not comprising any seam connecting said trousers element and said half-skirt element;

wherein said gap is adapted so that, when the trousers element is not worn, the half-skirt element is at least partially raisable and separable from the rear region of the trousers element covered by the half-skirt element.

11. A garment according to claim 1, wherein the lower extremal edge of the half-skirt element has a length greater than a length of the upper extremal edge.

12. A garment according to claim 11, wherein the length of said lower extremal edge is approximately 5% to 30% greater than the length of said upper extremal edge.

13. A garment according to claim 1, wherein the portion of the trousers element for covering said upper part of the buttocks, but not covered by the half-skirt element, comprises a plurality of elongated elements attached to each other by way of substantially vertically-developing seams, wherein said elongated elements form a rear waistband for the trousers element when attached to each other.

14. A garment according to claim 1, wherein the trousers element comprises:

in the front region:

a front waistband part which extends in and covers an upper band of the front region of the trousers element and two upper portions of the rear region of the trousers element adapted to cover an upper terminal part of the upper part of the buttocks, two front parts which extend in and cover the front region of the trousers element, below the front waistband part, up to the crotch region, the two front parts of the front region adapted to also cover a front part of the legs, the two front parts of the front region of the trousers element also comprise portions that extend in the two lateral region of the trousers element for covering hips and lateral parts of the buttocks, wherein said front waistband part and said two front parts are sewn to each other by an arched front seam having a concavity facing an upper edge of the trousers element for flattening an appearance of an upper part of the pelvis, and said two front parts are sewn to each other by a seam that centrally joins the two front parts departing from said arched front seam and ends in the crotch region crutch point, and in the rear part:

an upper rear part adapted to extend in and only cover the upper part of the buttocks that is flatter than the central part of the buttocks for better clinging to said upper part of the buttocks, a lower part adapted to extend in and only cover the central part of the buttocks and the lower terminal part of the buttocks, and adapted to then extend below the lower terminal part of the buttocks for covering a rear part of the legs, and two lateral parts adapted to extend in and cover the lateral parts of the buttocks, a rear lateral portion of the legs, and a front lateral portion of the legs;

wherein an arched transversal seam having a concavity facing the lower regions of the trousers element is dimensioned and shaped for surrounding the central part of the buttocks and for joining together the upper rear part of the trousers element, the lower rear part of the trousers element, and the two lateral parts of the trousers element, wherein vertically developing seams join to each other a plurality of parts that form the rear upper part of the trousers element, wherein connecting vertically developing seams join the lower part to the two lateral parts.

15. A garment according to claim 14, wherein said upper rear part adapted to extend in and only cover the upper part of the buttocks is formed of the plurality of parts sewn to each other for better clinging to said upper part of the buttocks.

16. A garment according to claim 1, wherein the half-skirt element comprises a lower section which extends downwards below the crotch region, said lower section having dimensions, as measured from said crotch region to the lower extremal edge of the half-skirt element, ranging from approximately 10 cm to 30 cm.

17. A garment according to claim 1, wherein the half-skirt element comprises a lower section which extends downwards below the crotch region, said lower section having dimensions, as measured from said crotch region to the lower extremal edge of the half-skirt element, ranging from approximately 5 cm to 20 cm.

* * * * *